US005861646A

United States Patent [19]

Czesnik et al.

[11] Patent Number: 5,861,646

[45] Date of Patent: Jan. 19, 1999

[54] METHOD OF PROCESSING DOCUMENTS MOVING ALONG A TRANSPORT PATH OF A DOCUMENT PROCESSING SYSTEM AND AN APPARATUS THEREFOR

[75] Inventors: Marek W. Czesnik, Kitchener; Ton Truong, Waterloo, both of Canada

[73] Assignee: NCR Corporation, Dayton, Ohio

[21] Appl. No.: 822,876

[22] Filed: Mar. 24, 1997

[51] Int. Cl.[6] ..... G01N 21/86

[52] U.S. Cl. ..... 250/559.4; 356/430

[58] Field of Search ..... 250/559.4, 559.45, 250/559.46, 559.3, 223 R; 356/430, 381, 385; 271/259

[56] References Cited

U.S. PATENT DOCUMENTS 4,397,460 8/1983 Milanes et al. ..... 250/223 R
4,707,598 11/1987 Croset et al. ..... 250/223 R

*Primary Examiner*—Que T. Le
*Attorney, Agent, or Firm*—Michael Chan

[57] ABSTRACT

An apparatus is provided for processing items moving along a transport path of a document processing system. The apparatus comprises a number of light sources located on one side of the transport path. A number of light sensors is located on the other side of the transport path and is provided for (i) sensing light from the light source transmitted through a variable first location of at least one item moving along the transport path and providing a first sensor output signal indicative of the extent of light transmitted, and (ii) sensing light from the light sources transmitted through a redefined second location of the at least one item moving along the transport path and providing a second sensor output signal indicative of the extent of light transmitted. A processing unit is responsive to the first and second sensor output signals and is provided for producing a first control signal indicative of a double-item feed condition when the first sensor output signal is indicative of transmitted light being below a first predetermined value and the second sensor output signal is indicative of transmitted light being below a second predetermined value. The processing unit produces a second control signal indicative of a false double-item feed condition when the first sensor output signal is indicative of transmitted light being below the first predetermined value and the second sensor output is indicative of transmitted light being above the second predetermined value.

6 Claims, 8 Drawing Sheets

METHOD OF PROCESSING DOCUMENTS MOVING ALONG A TRANSPORT PATH OF A DOCUMENT PROCESSING SYSTEM AND AN APPARATUS THEREFOR

BACKGROUND OF THE INVENTION

The present invention relates to document processing systems, and is particularly directed to a method of processing documents moving along a transport path of a document processing system, such as a check processing system, and an apparatus therefor.

There are a number of known arrangements of components for detecting a double-item feed condition in a document processing system having a transport path along which documents are movable. One known arrangement of components includes a number of light emitting diodes located on one side of the transport path and a corresponding number of phototransistors located on the other side of the transport path. Each phototransistor senses the amount of light transmitted through a document moving along the transport path and provides a sensor output signal indicative of the amount of transmitted light. If a single document is fed along the transport path, then the sensor output signal is within a predetermined range of values to indicate a normal feed condition. If overlapping multiple documents are fed along the transport path, then the sensor output signal is outside the predetermined range of values which would indicate a multiple-item feed condition.

A disadvantage in using this known arrangement of components is the inability to distinguish between detection of an actual multiple-item feed condition and detection of a "carrier" document. A carrier document is simply an envelope into which a damaged document can be placed to transport the damaged document along the transport path. The above-described arrangement of components may detect the presence of a carrier document as a multiple-item feed condition. Since a carrier document is not an actual multiple-feed condition, the result is a false indication of a multiple-feed condition. This false indication of a multiple-feed condition may cause the carrier document to be rejected. To avoid rejection of the carrier document, an operator may need to manually override the sensor output signal so that the carrier document can be processed as a normal feed condition along the transport path.

SUMMARY OF THE INVENTION

In accordance with one aspect of the present invention, a document processing system has a transport path along which items are movable. The document processing system comprises a number of light sources disposed along the transport path. A sensing unit is disposed along the transport path and is provided for (i) sensing the extent of light from the light sources transmitted through a variable first location of at least one item moving along the transport path, and (ii) sensing the extent of light from the light sources transmitted through a predefined second location of the at least one item moving along the transport path. A processing unit is responsive to the sensing unit and is provided for (i) producing a first control signal indicative of a double-item feed condition when transmitted light through the variable first location of the at least one item is below a first predetermined value and transmitted light through the predefined second location of the at least one item is below a second predetermined value.

Preferably, the processing unit produces a second control signal indicative of a false double-item feed condition when transmitted light through the variable first location of the at least one item is below the first predetermined value and transmitted light through the predefined second location of the at least one item is above the second predetermined value. Each light source includes a light emitting diode. The sensing unit includes (i) a number of light sensors disposed on one side of the transport path, and (ii) a number of light sensors disposed on the other side of the transport path. Each light sensor includes a phototransistor which provides a respective sensor output signal indicative of either the extent of light transmitted through the variable first location of the at least one item or the extent of light transmitted through the predefined second location of the at least one item. The processing unit includes a microcomputer which produces the first control signal in response to the sensor output signals from the phototransistors.

In accordance with another aspect of the present invention, an apparatus is provided for processing items moving along a transport path of a document processing system. The apparatus comprises a number of light sources located on one side of the transport path. A number of light sensors is located on the other side of the transport path and is provided for (i) sensing light from the light sources transmitted through a variable first location of at least one item moving along the transport path and providing a first sensor output signal indicative of the extent of light transmitted, and (ii) sensing light from the light sources transmitted through a predefined second location of the at least one item moving along the transport path and providing a second sensor output signal indicative of the extent of light transmitted. A processing unit is responsive to the first and second sensor output signals and is provided for producing a first control signal indicative of a double-item feed condition when the first sensor output signal is indicative of transmitted light being below a first predetermined value and the second sensor output signal is indicative of transmitted light being below a second predetermined value.

In accordance with yet another aspect of the present invention, a method of processing items moving along a transport path of a document processing system comprises the steps of (a) sensing light transmitted through a variable first location of at least one item moving along the transport path and providing a first signal indicative of the extent of light transmitted, (b) sensing light transmitted through a predefined second location of the at least one item moving along the transport path and providing a second signal indicative of the extent of light transmitted, and (c) indicating a double-item feed condition when the first signal is indicative of transmitted light being below a first predetermined value and the second signal is indicative of transmitted light being below a second predetermined value.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DETAILS OF THE INVENTION

Figure 1:
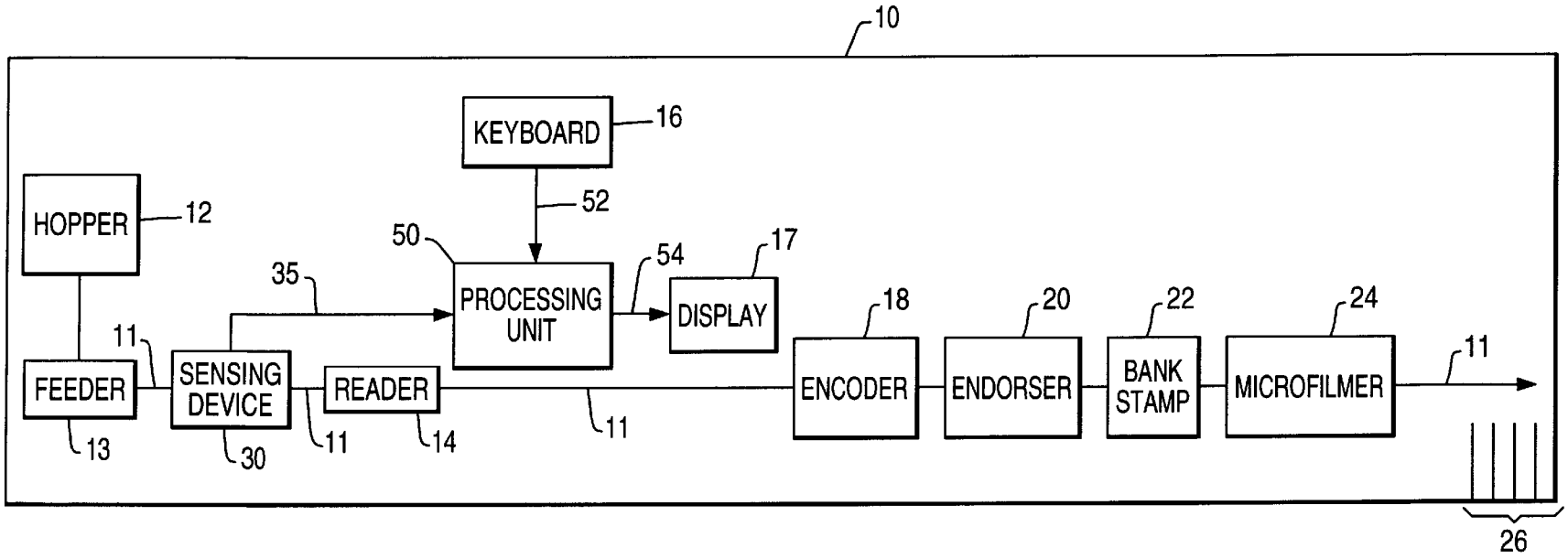
FIG. 1 is a schematic view of document processing system having a transport path and embodying an apparatus constructed in accordance with the present invention.

The present invention is directed to a method of processing items moving along a transport path of a document processing system and an apparatus therefor. The specific construction and use of the document processing system may vary. By way of example, a document processing system in the form of a check processing system 10 is illustrated in FIG. 1. The check processing system 10 may be, for example, a sorting machine or a proof machine wherein documents such as bank checks are processed in a data processing operation.

As shown in FIG. 1, the check processing system 10 includes a hopper 12 into which a plurality of bank checks (not shown in FIG. 1) are placed. A feeder 13 adjacent the hopper 12 selectively feeds or drives each check from the hopper along a transport path 11 to sorting bins 26 located at the end of the transport path. A reader 14 located along the transport path 11 reads data on each check for the purpose of validating the data.

An encoder 18 encodes any missing fields on the checks. An endorser 20 applies an endorsement in a known manner to the checks. A bank stamp 22 stamps each check to identify the bank institution processing the check. A microfilmer 24 then films each check after the front and back sides of the check have been identified. After each check is microfilmed, the check is transported to one of the sorting bins 26 depending upon the data on the check.

A processing unit 50 monitors signals on line 52 from a keyboard 16 and provides output signals on line 54 to a display 17. The keyboard 16 allows an operator to enter data, such as missing or unreadable fields on the checks moving along the transport path 11. Preferably, the processing unit 50 includes a microcomputer and a memory which communicates with the microcomputer. Suitable microcomputers and memories are readily available in the marketplace. Their structure and operation are well known and, therefore, will not be described.

The microcomputer of the processing unit 50 monitors output signals from certain components disposed along the transport path 11 and controls operation of components disposed along the transport path in response to the output signals from the certain components. Operation of the components is controlled in accordance with a program stored in the memory of the processing unit 50. The components are controlled in accordance with the program to separate the checks according to a desired format, as is known.

Figure 2:
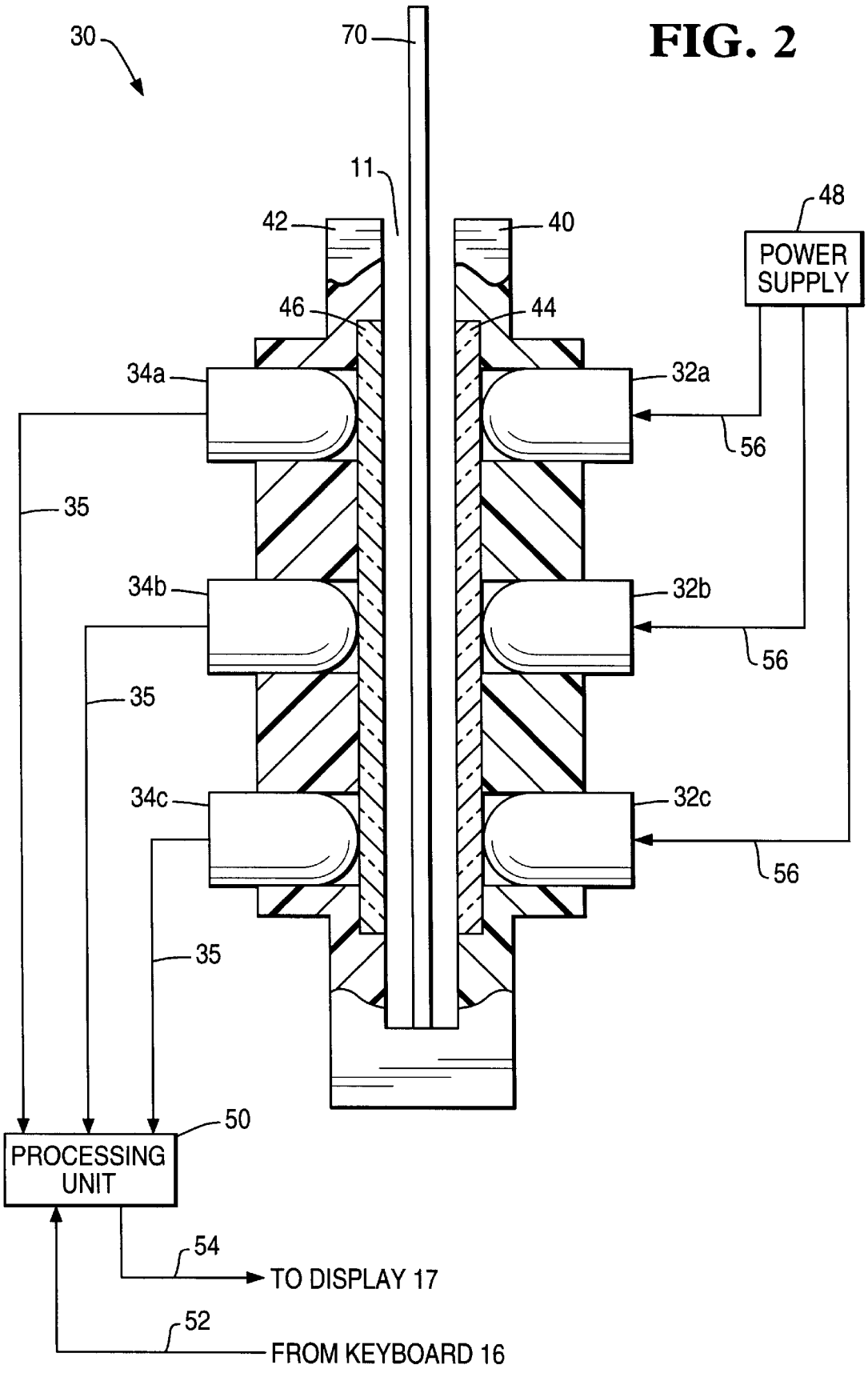
FIG. 2 is a sectional view of the apparatus of FIG. 1 in which a single document is moving along the transport path.

A sensing device 30 is located along the transport path 11 and between the feeder 13 and the reader 14, as shown in FIG. 1. Referring to FIG. 2, the sensing device 30 includes three light emitting diodes 32*a*, 32*b*, 32*c* disposed on one side of the transport path 11 and three phototransistors 34*a*, 34*b*, 34*c* located on the other side of the transport path. The three light emitting diodes 32*a*, 32*b*, 32*c* are collectively referred to as "light emitting diodes 32", and the three phototransistors 34*a*, 34*b*, 34*c* are collectively referred to as "phototransistors 34". Each of the phototransistors 34 faces a respective one of the light emitting diodes 32. Although only three pairs of light emitting diodes and phototransistors are described herein, it is contemplated that a different number of pairs of light emitting diodes and phototransistors could be used.

The light emitting diodes 32 are mounted in a housing portion 40 on the one side of the transport path 11, as shown in FIG. 2. A transparent flat piece 44 is attached to the housing portion 40 to protect the light emitting diodes 32 from contacting checks moving along the transport path. Similarly, the phototransistors 34 are mounted in another housing portion 42 on the other side of the transport path 11. A transparent flat piece 46 is attached to the housing portion 42 to protect the phototransistors 34 from contacting checks moving along the transport path 11.

A power supply 48 supplies electrical power on lines 56 to each of the light emitting diodes 32. The power supply 48 is controlled by the processing unit 50. Alternatively, the power supply 48 may be independently controlled.

The processing unit 50 monitors signals on lines 35 from the phototransistors 34. As already mentioned, the processing unit 50 also monitors signals on line 52 from the keyboard 16. In response to the signals on lines 35 from the phototransistors 34 and the signals on line 52 from the keyboard 16, the processing unit 50 provides output signals on line 54 to the display 17. More specifically, the microcomputer of the processing unit 50 processes the signals on line 52 from the keyboard 16 and the signals on lines 35 from the phototransistors 34 in accordance with a program stored in the memory of the processing unit 50. This program enables the microcomputer to determine, in accordance with the present invention, if a double-item feed condition is present along the transport path 11, as described in detail hereinbelow.

When a single document 70 is moving along the transport path 11 and is in the sensing device 30, such as shown in FIG. 2, the light emitting diodes 32 transmit a certain amount of light through the document 70. The amount of transmitted light is sensed by the phototransistors 34. More specifically, the amount of transmitted light sensed by the phototransistors 34 is above a first predetermined value stored in the memory of the processing unit 50.

Figure 3:
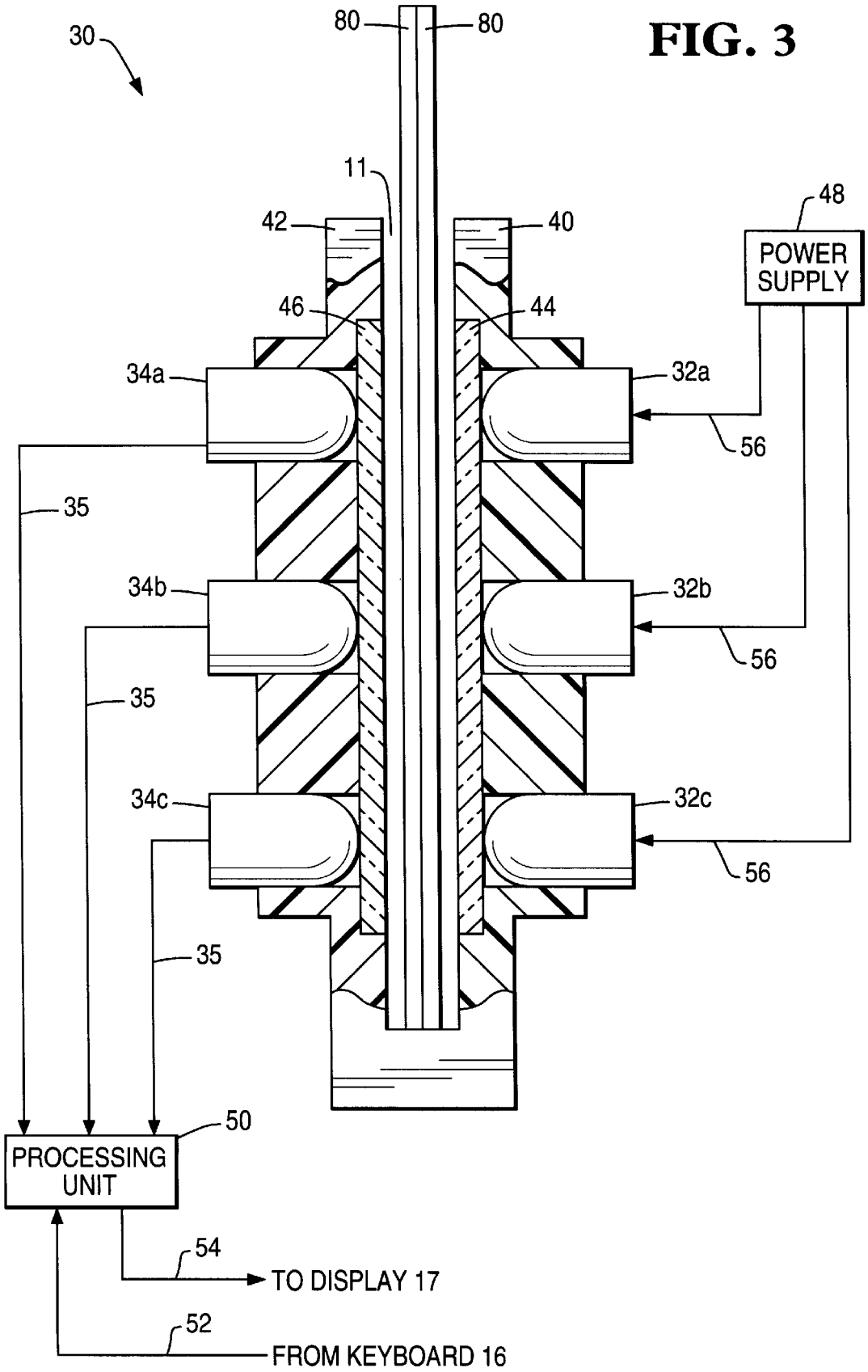
FIG. 3 is a view similar to FIG. 2 and showing overlapping multiple documents moving along the transport path.

If multiple overlapping documents, such as two documents 80 shown in FIG. 3, are moving along the transport path 11 and is in the sensing device 30, the phototransistors 34 sense a lesser amount of light transmitted through the two documents than the amount of light transmitted through the single document 70 of FIG. 2. More specifically, the amount of transmitted light sensed by the phototransistors 34 is below the first predetermined value. When the amount of transmitted light is below the first predetermined value, the processing unit 50 determines that a double-item feed condition exists and provides a control signal on line 54 to the display 17 indicative thereof.

Figure 4:
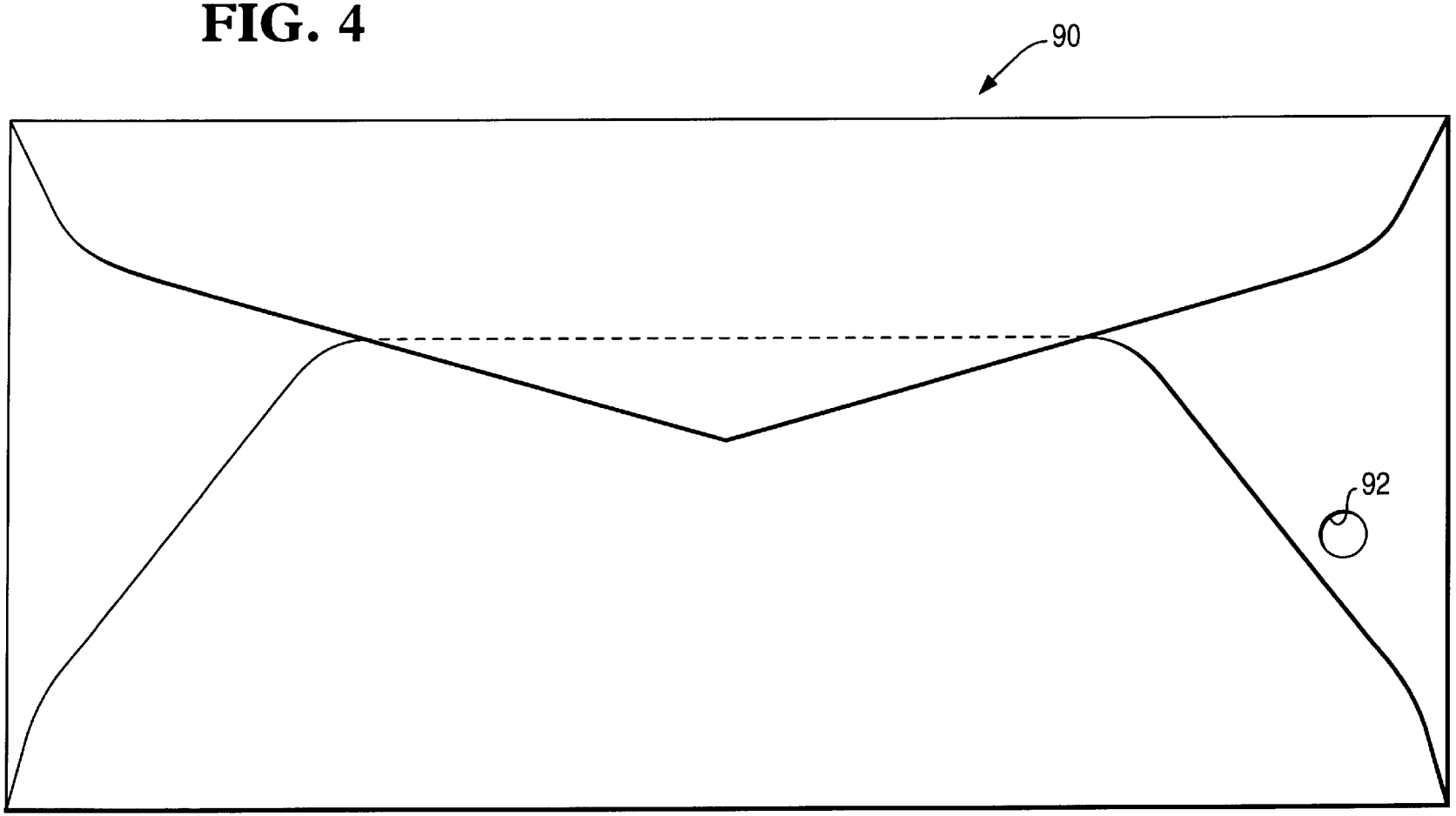
FIG. 4 is a schematic view of a carrier document having a hole at a predefined location.

Referring to FIG. 4, a carrier document in the form of an envelope 90 has a hole 92 at a predefined location. The predefined location may be at either the leading or trailing edges, for example, of the envelope 90. For purposes of explanation, the hole 92 shown in FIG. 4 is located at the trailing edge of the envelope 90. The envelope 90 is provided for carrying a damaged single document along the transport path 11. An envelope carries one damaged single document. An operator manually inserts each damaged single document into a separate envelope.

Figure 5:
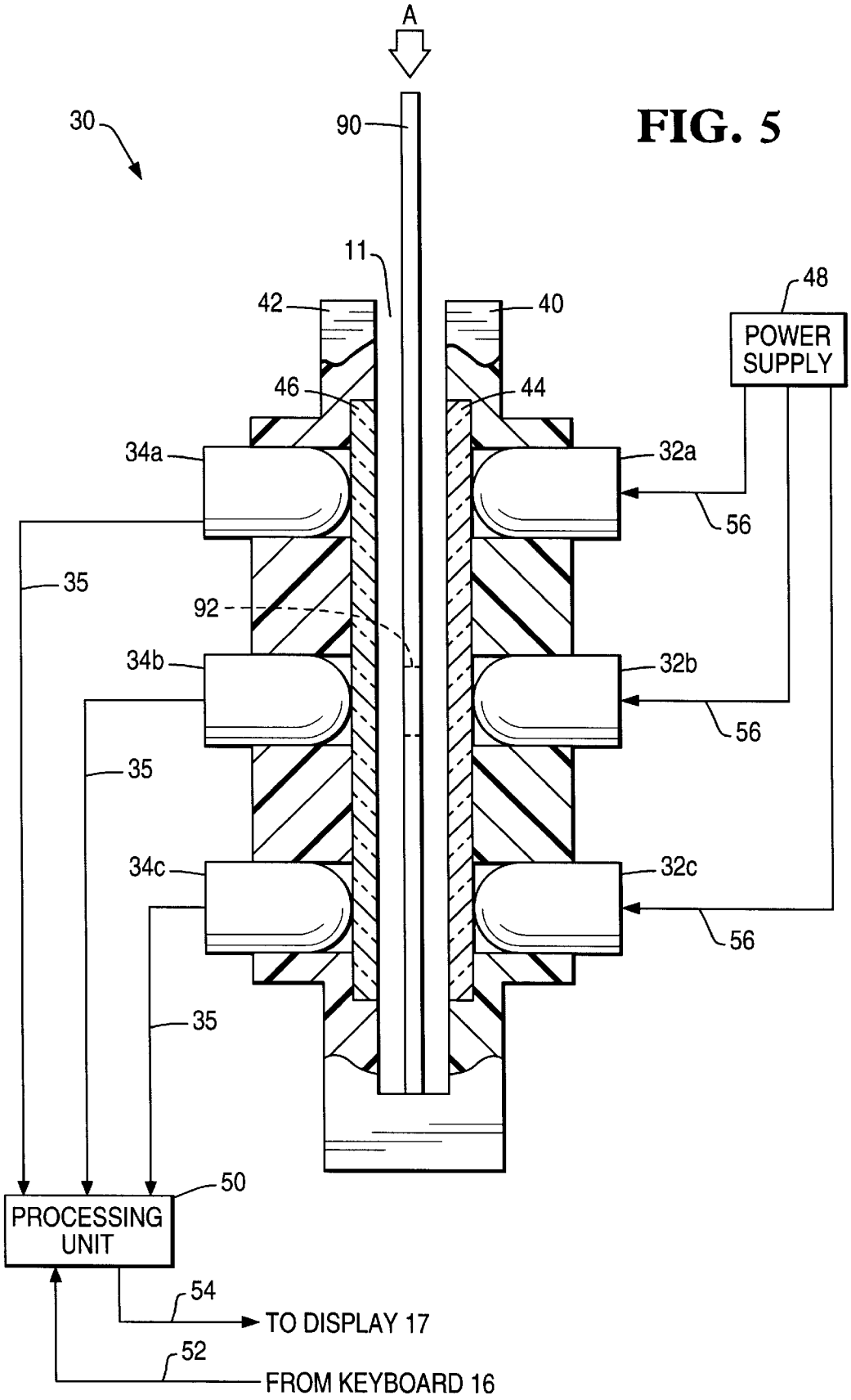
FIG. 5 is a view similar to FIG. 2 and showing the carrier document of FIG. 4 moving along the transport path.
Figure 6:
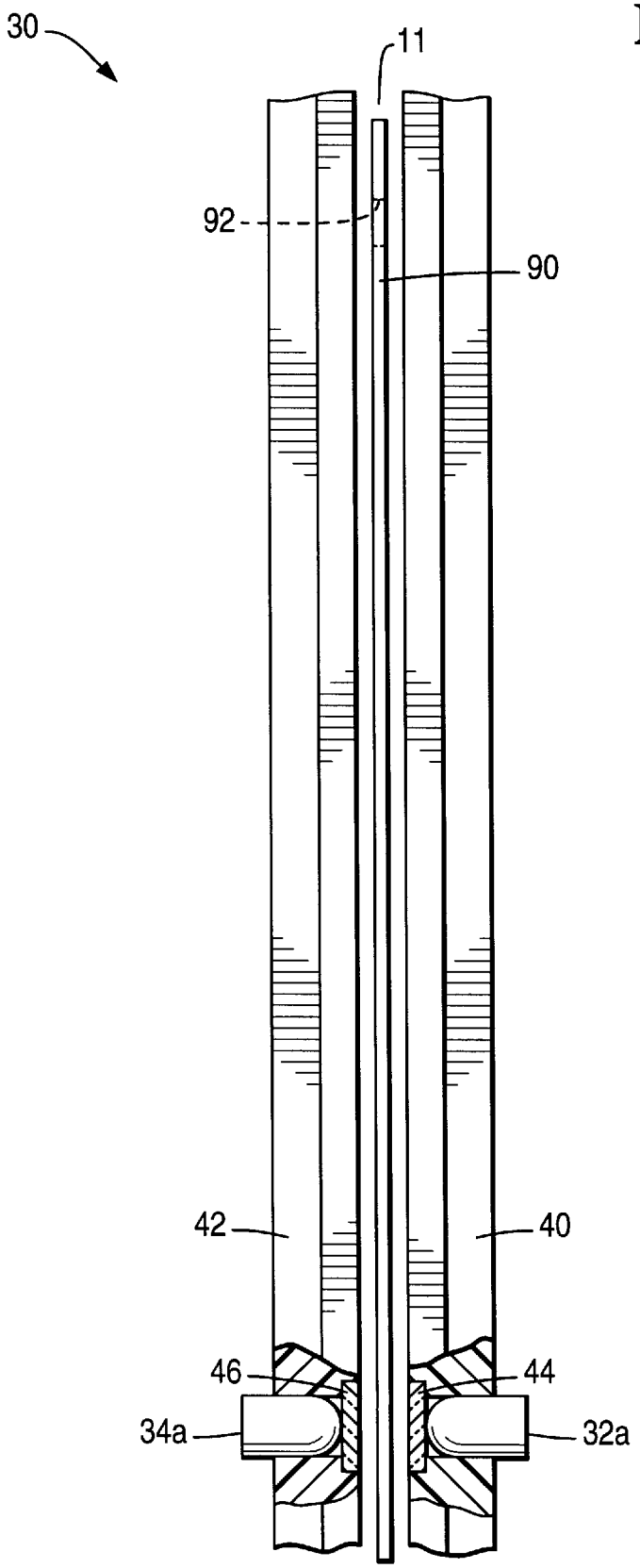
FIG. 6 is a view looking in the direction of arrow A in FIG. 5.

When the envelope 90, such as shown in FIG. 4, is moving along the transport path 11 and is in the sensing device 30 as shown in FIGS. 5 and 6, the phototransistors 34 sense a lesser amount of light transmitted through the carrier document 90 than the amount of light transmitted through the single document 70 of FIG. 2. More specifically, the amount of transmitted light sensed by the phototransistors 34 is below the first predetermined value. When the amount of transmitted light is below the first predetermined value, the microcomputer of the processing unit 50 determines that a double-item feed condition may exist.

Figure 7:
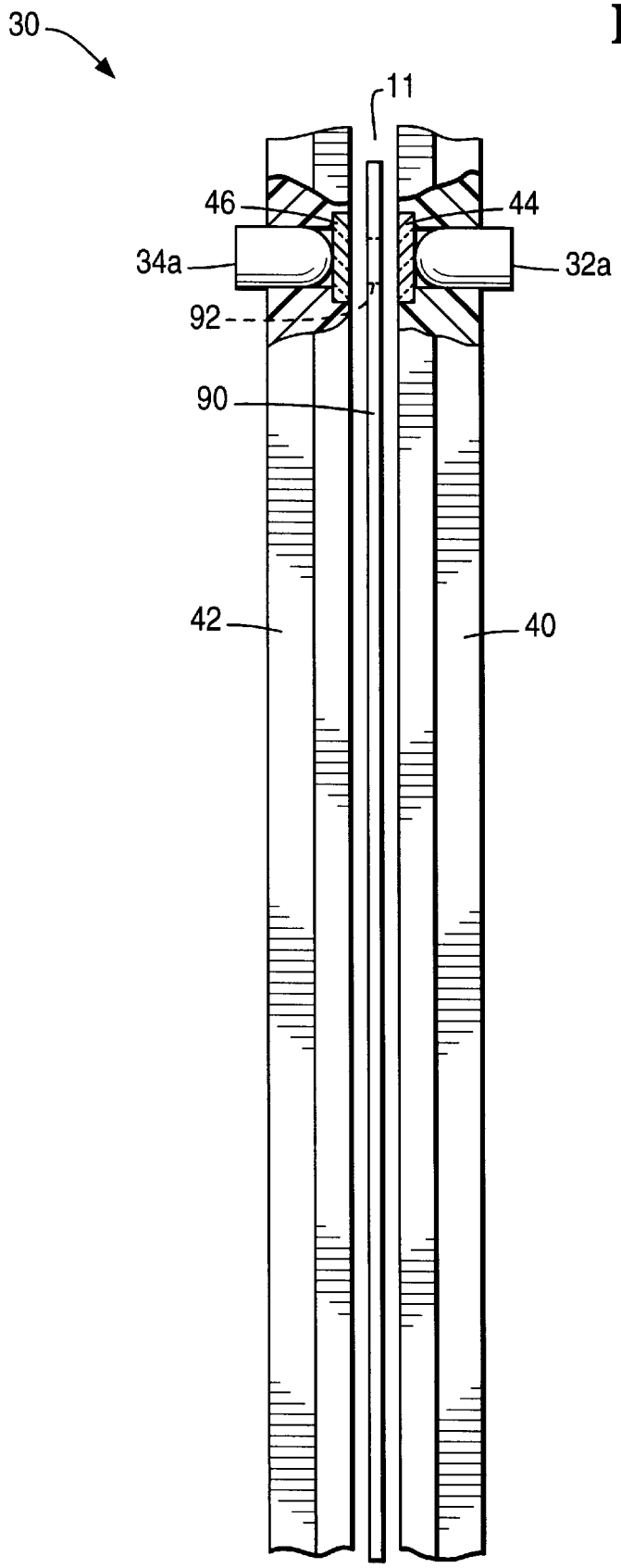
FIG. 7 is a view similar to FIG. 6 and showing the carrier document in a different position.

The envelope 90 continues moving along the transport path 11 from the position shown in FIG. 6 to the position shown in FIG. 7. When the envelope 90 reaches the position shown in FIG. 7, the amount of transmitted light sensed by the two phototransistors 34*a*, 34*c* remains below the first predetermined value and the amount of transmitted light sensed by the phototransistor 34*b* increases above the first predetermined value. The amount of transmitted light sensed by the phototransistor 34*b* increases above the first predetermined value because of the presence of the hole 92 at the trailing edge of the envelope 90. The amount of transmitted light sensed by the phototransistor 34*b* remains above the first predetermined value for a predetermined period of time depending upon the actual size of the hole 92 and the actual speed which the envelope 90 is moving along the transport path 11.

Figure 8:
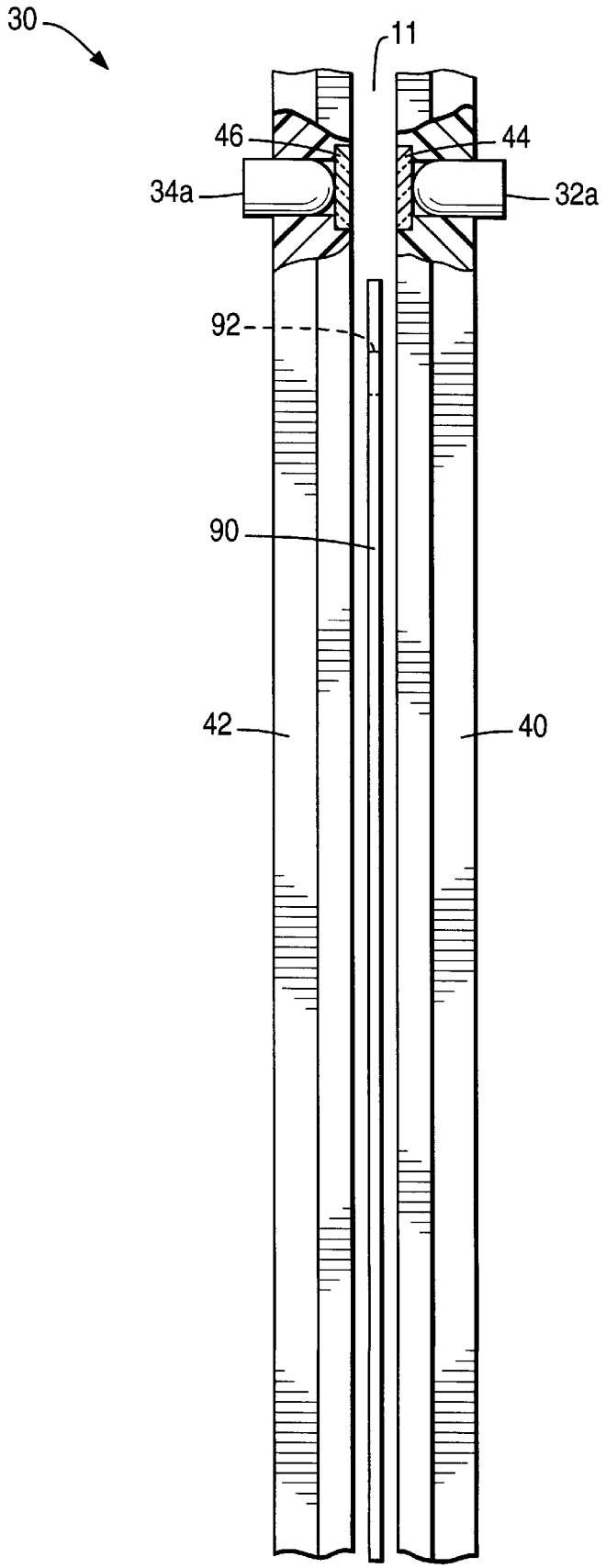
FIG. 8 is a view similar to FIG. 7 and showing the carrier document in another different position.

When the amount of transmitted light sensed by the two phototransistors 34*a*, 34*c* remains below the first predetermined value and the amount of transmitted light sensed by the phototransistor 34*b* increases above the first predetermined value for the predetermined period of time, as just described hereinabove, the microcomputer of the processing unit 50 determines that an envelope is moving along the transport path 11 and that an actual double-item feed condition does not exist. The envelope 90 continues moving along the transport path 11 from the position shown in FIG. 7 to the position shown in FIG. 8 to allow the next item to move between the light emitting diodes 32 and the phototransistors 34.

A number of advantages result by providing the sensing device 30 in accordance with the present invention. One advantage is that interruption of the document processing system 10 due to an envelope moving along the transport path 11 and causing a false double-item feed condition is eliminated or at least minimized. Another advantage is that the cost of retrofitting existing document processing systems with a sensing device constructed in accordance with the present invention is relatively low and inexpensive.

From the above description of the invention, those skilled in the art to which the present invention relates will perceive improvements, changes and modifications. Numerous substitutions and modifications can be undertaken without departing from the true spirit and scope of the invention. Such improvements, changes and modifications within the skill of the art to which the present invention relates are intended to be covered by the appended claims.

What is claimed is:

1. An apparatus for detecting presence of check documents and carrier documents which carry check documents along a transport path of a check processing system, the apparatus comprising:

a first light source disposed along one side of the transport path;

a first light sensor disposed along an opposite side of the transport path from the first light source and for receiving light transmitted from the first light source through a number of documents moving along the transport path;

a second light source disposed along one side of the transport path;

a second light sensor disposed along an opposite side of the transport path from the second light source and for receiving light transmitted from the second light source through a number of documents moving along the transport path; and a processing unit for (i) producing a first signal indicative of a true double-feed condition which corresponds to presence of at least two overlapping check documents moving along the transport path when the extent of transmitted light received by the first light sensor is below a first predetermined value and the extent of transmitted light received by the second light sensor is below a second predetermined value, and (ii) producing a second signal indicative of a false double-feed condition which corresponds to presence of a carrier document moving along the transport path when the extent of transmitted light received by the first light sensor is above a third predetermined value and the extent of transmitted light received by the second light sensor is below a fourth predetermined value.

2. An apparatus according to claim 1, wherein the first and third predetermined values are substantially equal, and the second and fourth predetermined values are substantially equal.

3. An apparatus for detecting presence of checks and envelopes which carry checks moving along a transport path of a check processing system, the apparatus comprising:

a first light source disposed along one side of the transport path;

a first light sensor disposed along an opposite side of the transport path from the first light source and for receiving light transmitted from the first light source through a number of checks or an envelope moving along the transport path;

a second light source disposed along one side of the transport path;

a second light sensor disposed along an opposite side of the transport path from the second light source and for receiving light transmitted from the second light source through a number of checks or an envelope moving along the transport path; and a processing unit for (i) producing a first signal indicative of a true double-feed condition which corresponds to presence of at least two overlapping checks moving along the transport path when the extent of light transmitted from the first light source through the overlapping checks and received by the first light sensor is below a first predetermined value and the extent of light transmitted from the second light source through the overlapping checks and received by the second light sensor is below a second predetermined value, and (ii) producing a second signal indicative of a false double-feed condition which corresponds to presence of an envelope moving along the transport path when the extent of light transmitted from the first light source through an opening at a predefined location of the envelope and received by the first light sensor is above a third predetermined value and the extent of light transmitted from the second light source through a location other than the opening at the predefined location of the envelope and received by the second light sensor is below a fourth predetermined value.

4. An apparatus according to claim 3, wherein the first and third predetermined values are substantially equal, and the second and fourth predetermined values are substantially equal.

5. A method of detecting presence of check documents and carrier documents which carry check documents along a transport path of a check processing system, the method comprising the steps of:

(a) sensing the extent of light transmitted through a first portion of a number of documents moving along the transport path;

(b) sensing the extent of light transmitted through a second portion of the documents moving along the transport path;

(c) producing a first signal indicative of a true double-feed condition which corresponds to presence of at least two overlapping check documents moving along the transport path when the extent of light transmitted through the first portion of the documents moving along the transport path is below a first predetermined value and the extent of light transmitted through the second portion of the documents moving along the transport path is below a second predetermined value; and (d) producing a second signal indicative of a false double-feed condition which corresponds to presence of a carrier document moving along the transport path when the extent of light transmitted through the first portion of the documents moving along the transport path is above a third predetermined value and the extent of light transmitted through the second portion of the documents moving along the transport path is below a fourth predetermined value.

6. An apparatus according to claim 5, wherein the first and third predetermined values are substantially equal, and the second and fourth predetermined values are substantially equal.

* * * * *